US005959649A

United States Patent [19]

Dietl et al.

[11] Patent Number: 5,959,649

[45] Date of Patent: Sep. 28, 1999

[54] INK SUPPLY SYSTEM FOR A THERMAL INK-JET PRINTER

[75] Inventors: Steven J. Dietl, Ontario; Michael Carlotta, Sodus, both of N.Y.

[73] Assignee: Xerox Corporation, Stamford, Conn.

[21] Appl. No.: 08/363,087

[22] Filed: Dec. 23, 1994

Related U.S. Application Data

[63] Continuation of application No. 07/885,704, May 19, 1992, Pat. No. 5,420,625.

[51] Int. Cl.[6] ..... B41J 2/175

[52] U.S. Cl. ..... 347/87

[58] Field of Search ..... 347/85–87

[56] References Cited

U.S. PATENT DOCUMENTS

| | | | |
|---|---|---|---|
| 4,771,295 | 9/1988 | Baker et al. | 347/87 |
| 4,929,969 | 5/1990 | Morris | 347/87 |
| 5,182,581 | 1/1993 | Kashimura et al. | 347/87 |
| 5,216,450 | 6/1993 | Koitabashi et al. | 347/87 |

*Primary Examiner*—N. Le
*Attorney, Agent, or Firm*—R. Hutter

[57] ABSTRACT

A system for supplying liquid ink to a thermal ink-jet printing apparatus comprises a housing defining a single chamber having a ventilation port and an outlet port. A medium occupies at least a portion of the chamber, the medium being adapted to retain a quantity of liquid ink. A scavenger member is disposed across the outlet port, providing a capillary force greater than that of the medium.

7 Claims, 4 Drawing Sheets

INK SUPPLY SYSTEM FOR A THERMAL INK-JET PRINTER

CROSS-REFERENCE TO RELATED APPLICATION

Cross-reference is made to U.S. Pat. No. 5,289,212, "Air Vent for an Ink Supply Cartridge in a Thermal Ink-jet Printer," filed concurrently with the parent application hereof. This is a continuation of application Ser. No. 07/885,704, filed May 19, 1992, now U.S. Pat. No. 5,420,625.

FIELD OF THE INVENTION

The present invention relates to a system for supplying liquid ink to a printhead in a thermal ink-jet printing apparatus.

BACKGROUND OF THE INVENTION

In existing thermal ink jet printing, the printhead comprises one or more ink filled channels, such as disclosed in U.S. Pat. No. 4,463,359, communicating with a relatively small ink supply chamber, or manifold, at one end and having an opening at the opposite end, referred to as a nozzle. A thermal energy generator, usually a resistor, is located in each of the channels, a predetermined distance from the nozzles. The resistors are individually addressed with a current pulse to momentarily vaporize the ink and form a bubble which expels an ink droplet. As the bubble grows, the ink bulges from the nozzle and is contained by the surface tension of the ink as a meniscus. As the bubble begins to collapse, the ink still in the channel between the nozzle and bubble starts to move towards the collapsing bubble, causing a volumetric contraction of the ink at the nozzle and resulting in the separation of the bulging ink as a droplet. The acceleration of the ink out of the nozzle while the bubble is growing provides the momentum and velocity of the droplet in a substantially straight line direction towards a recording medium, such as paper. Because the droplet of ink is emitted only when the resistor is actuated, this general type of thermal ink-jet printing is known as "drop-on-demand" printing.

The printhead of U.S. Pat. No. 4,463,359 has one or more ink-filled channels which are replenished by capillary action. A meniscus is formed at each nozzle to prevent ink from weeping therefrom. A resistor or heater is located in each channel upstream from the nozzles. Current pulses representative of data signals are applied to the resistors to momentarily vaporize the ink in contact therewith and form a bubble for each current pulse. Ink droplets are expelled from each nozzle by the growth and collapse of the bubbles. The current pulses to the heater are shaped to prevent the meniscus from breaking up and receding too far into the channels after each droplet is expelled. Various embodiments of linear arrays of thermal ink jet devices are known, such as those having staggered linear arrays attached to the top and bottom of a heat sinking substrate and those having different colored inks for multiple colored printing.

A common type of printhead is known as a "sideshooter." Sideshooters are so named because the ink droplets are emitted through the channel at a right angle relative to the heating element. U.S. Pat. No. 4,774,530 describes such a construction in greater detail. U.S. Pat. No. 4,638,337 describes a side-shooter in which the sudden release of vaporized ink known as blowout is prevented by disposing the heater in a recess.

In current practical embodiments of drop-on-demand thermal ink-jet printers, it has been found that the printers work most effectively when the pressure of the ink in the printhead nozzle is kept within a predetermined range of gauge pressures. Specifically, at those times during operation in which an individual nozzle or an entire printhead is not actively emitting a droplet of ink, it is important that a certain negative pressure, or "back pressure," exist in each of the nozzles and, by extension, within the ink supply manifold of the printhead. A discussion of desirable ranges for back pressure in thermal ink-jet printing is given in the "Xerox Disclosure Journal," Vol. 16, No. 4, July/August 1991, p. 233. This back pressure is important for practical applications to prevent unintended leakage, or "weeping," of liquid ink out of the nozzles onto the copy surface. Such weeping will obviously have adverse results on copy quality, as liquid ink leaks out of the printhead uncontrollably.

A typical end-user product in this art is a cartridge in the form of a prepackaged, usually disposable item comprising a sealed container holding a supply of ink and, operatively attached thereto, a printhead having a linear or matrix array of channels. Generally the cartridge may include terminals to interface with the electronic control of the printer; electronic parts in the cartridge itself are associated with the ink channels in the printhead, such as the resistors and any electronic temperature sensors, as well as digital means for converting incoming signals for imagewise operation of the heaters. In one common design of printer, the cartridge is held with the printhead against the sheet on which an image is to be rendered, and is then moved across the sheet periodically, in swaths, to form the image, much like a typewriter. Full-width linear arrays, in which the sheet is moved past a linear array of channels which extends across the full width of the sheet, are also known. Typically, cartridges are purchased as needed by the consumer and used either until the supply of ink is exhausted, or, equally if not more importantly, until the amount of ink in the cartridge becomes insufficient to maintain the back pressure of ink to the printhead within the useful range.

Other considerations are crucial for a practical ink supply as well. The back pressure, for instance, must be maintained at a usable level for as long as possible while there is still a supply of ink in an ink cartridge. Therefore, a cartridge must be so designed as to maintain the back pressure within the usable range for as large a proportion of the total range of ink levels in the cartridge as possible. Failure to maintain back pressure causes the ink remaining in the cartridge to leak out through the printhead or otherwise be wasted.

U.S. Pat. No. 4,095,237 discloses an ink supply to a movable printing head in which a flow path is located in the flow path of a liquid reservoir of ink in communication with the printhead. The disclosed material for the filter is foam rubber or foam plastic. The printhead is raised higher than the outlet port of the reservoir.

U.S. Pat. No. 4,419,678 discloses a modular ink supply system for an ink-jet printer wherein a liquid ink supply container is inserted into the printing apparatus, and communicating tubes puncture the container to form a tight seal against the outlet port and ventilation port of the container.

Pending U.S. patent application Ser. No. 07/634,585, assigned to the present assignee, discloses an ink-supply cartridge wherein two chambers are provided, the upper chamber having a capillary foam and the lower chamber substantially filled with ink. The printhead is disposed at a vertical height greater than the top level of the lower chamber. A second capillary foam, disposed along the supply line to the printhead, has a capillarity greater than that of the foam in the upper chamber. In another embodiment, only one chamber, corresponding to the lower chamber in the first embodiment and having no capillary foam therein, is provided.

In earlier patents, felt substances have been used for the control of the flow of liquid ink. For example, U.S. Pat. No. 4,751,527 describes an ink-jet "typeprinter" in which a plurality of holes are formed in a film and then filled with ink. Selectively heating areas of the film generates bubbles in the ink and ejects the ink due to the pressure of the bubbles, thus printing an image on a sheet. In order to convey the ink to the film at the beginning of the process, felt ink supply members are employed to act as wicks for the gradual flow of ink into the film.

U.S. Pat. No. 4,394,669 discloses an ink jet recording apparatus having a printhead which moves relative to the copy surface. Felt members are employed to act as absorbing means to collect excess effluent liquid from the printhead.

U.S. Pat. No. 4,803,502 discloses an image formation cartridge having a number of rollers for applying ink to an image formation sheet. Each ink applying roller is in contact with an ink feeding element, which is made of a porous material such as polytetrafluoroethylene felt.

U.S. Pat. No. 4,771,295 discloses an ink-supply cartridge construction having multiple ink storage compartments. Ink is stored in a medium of reticulated polyurethane foam of controlled porosity and capillarity. The medium empties into ink pipes, which are provided with wire mesh filters for filtering of air bubbles and solid particles from the ink. The foam is also compressed to reduce the pore size therein, thereby reducing the foam thickness while increasing its density; in this way, the capillary force of the foam may be increased.

U.S. Pat. No. 4,791,438 discloses an ink jet pen (ink supply) including a primary ink reservoir and a secondary ink reservoir, with a capillary member forming an ink flow path between them. This capillary member draws ink from the primary reservoir toward the secondary ink reservoir by capillary action as temperature and pressure within the primary reservoir increases. Conversely, when temperature and pressure in the housing decreases, the ink is drawn back toward the primary reservoir.

U.S. Pat. No. 4,929,969 discloses an ink supply reservoir for drop-on-demand ink jet printing, including a medium in the form of a mass of foam material. This foam material comprises a three dimensionally branched network of fine filaments creating interstitial pores of uniform size. In preferred embodiments of the invention described, this foam material is a thermoset melamine condensate. In this patent, it is further pointed out that foam materials, when used as a medium for liquid ink, exert a controlled capillary back pressure.

SUMMARY OF THE INVENTION

In accordance with one aspect of the present invention, a system for supplying liquid ink to a thermal ink-jet printing apparatus comprises a housing defining a single chamber having a ventilation port and an outlet port. A medium occupies at least a portion of the chamber, the medium being adapted to retain a quantity of liquid ink. A scavenger member is disposed across the outlet port, providing a capillary force greater than that of the medium.

BRIEF DESCRIPTION OF THE DRAWINGS

While the present invention will hereinafter be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 3:
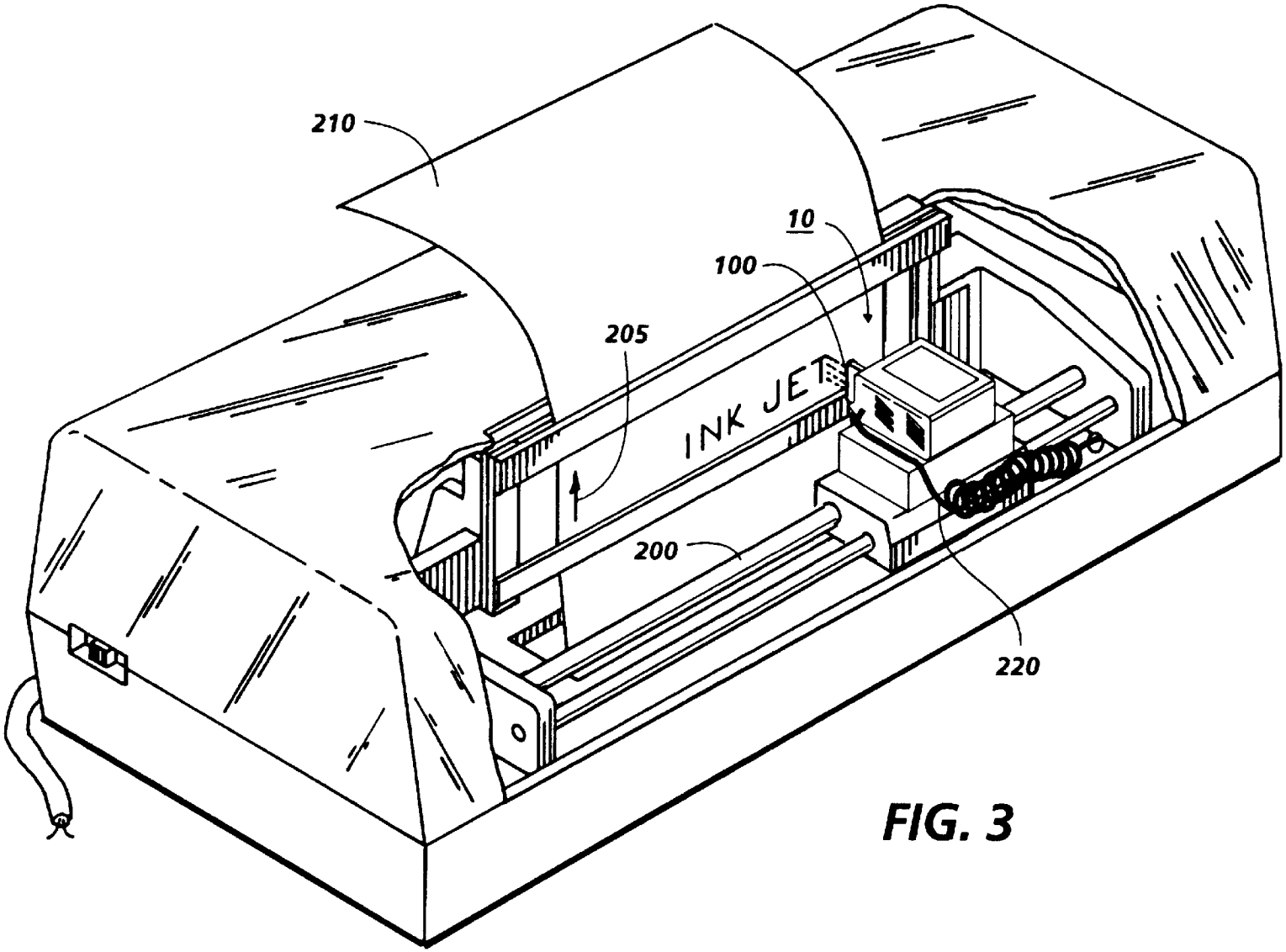
FIG. 3 is an elevational view of a thermal ink jet printing apparatus.

FIG. 3 is a general elevational view of a type of thermal ink-jet printer in which the printhead and the ink supply therefor are combined in a single package, referred to hereinafter as cartridge 10. The main portion of cartridge 10 is the ink supply, with another portion forming the actual printhead 100. In this embodiment of the invention, cartridge 10 is placed within a larger thermal ink jet printing apparatus in which the cartridge 10 is caused to move along carriage 200 in such a way that printhead 100, moving relative to sheet 210, may print characters on the sheet 210 as the cartridge 10 moves across the sheet, somewhat in the manner of a typewriter. In the example illustrated, printhead 100 is of such a dimension that each path of cartridge 10 along sheet 210 enables printhead 100 to print out a single line of text, although it is generally not necessary for the text lines to conform to the swaths of the copy cartridge 10. With each swath of cartridge 10, sheet 210 may be indexed (by means not shown) in the direction of the arrow 205 so that any number of passes of printhead 100 may be employed to generate text or image onto the sheet 210. Cartridge 10 also includes means, generally shown as 220, by which digital image data may be entered into the various heating elements 110 of printhead 100 to print out the desired image. These means 220 may include, for example, plug means which are incorporated in the cartridge 10 and which accept a bus or cable from the data-processing portion of the apparatus, and permit an operative connection therefrom to the heating elements in the printhead 100.

Figure 1A:
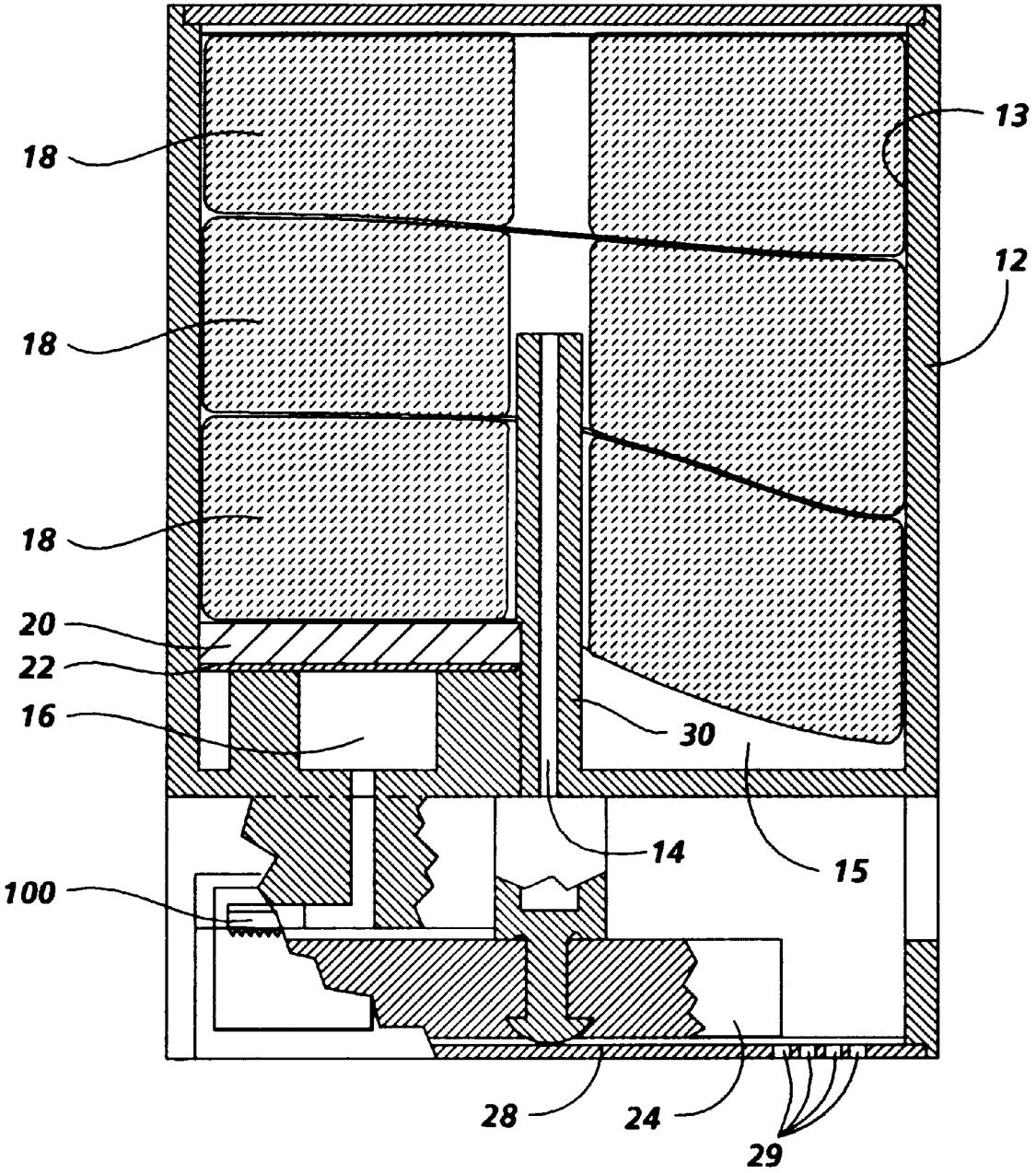
FIG. 1A is a sectional, elevational view of a cartridge incorporating the present invention.

FIG. 1A is a sectional, elevational view of cartridge 10. The cartridge 10 has a main portion in the form of a housing 12. Housing 12 is typically made of a lightweight but durable plastic. Housing 12 defines a chamber 13 for the storage of liquid ink, and further has defined therein a ventilation port 14, open to the atmosphere, and an output port 16. At the end of the output port 16 (as shown at the broken portion of FIG. 1A) is an ink jet printhead 100, and specifically the ink supply manifold thereof, substantially as described above. An ink-saturated medium, shown here as three separate portions each marked 18, which will be described in detail below, occupies most of the chamber 13 of housing 12.

Figure 1B:
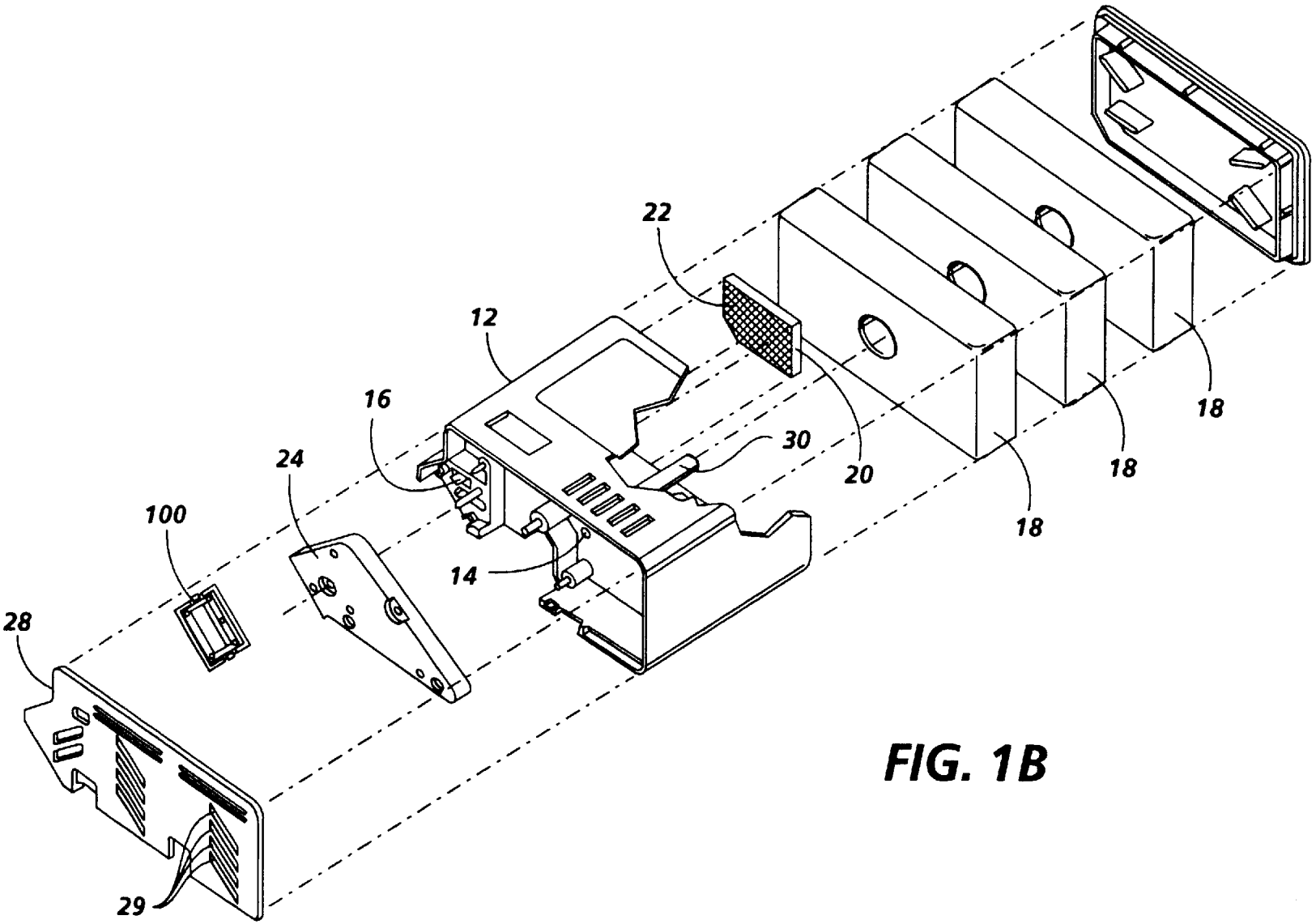
FIG. 1B is an exploded view of a cartridge as in FIG. 1A incorporating the present invention.

FIG. 1B is an exploded view of cartidge 10, showing how the various elements of cartridge 10 may be formed into a compact customer-replaceable unit. Other parts of the cartridge 10 which are useful in a practical embodiment of the invention include a heat sink 24 and cover 28 having openings 29 therein to permit ventilation of the interior of housing 12 through ventilation port 14. A practical design will typically include space for on-board circuitry for selective activation of the heating elements in the printhead 100.

Also shown in FIGS. 1A and 1B is a tube 30 extending from ventilation port 14 toward the center of the interior of housing 12, through openings in each portion of medium 18. The purpose and function of tube 30 is described in detail in U.S. Pat. No. 5,289,212, "Air Vent for an Ink Supply Cartridge in a Thermal Ink-Jet Printer," filed concurrently herewith.

In the preferred embodiment of the invention, medium 18 (shown as three portions of material) is in the form of a needled felt of polyester fibers. Needled felt is made of fibers physically interlocked by the action of, for example, a needle loom, although in addition the fibers may be matted together by soaking or steam heating. According to the preferred embodiment of the present invention, the needled felt should be of a density of between 0.06 and 0.13 grams per cubic centimeter. It has been found that the optimum density of this polyester needled felt forming medium 18 is 0.095 grams per cubic centimeter. This optimum density reflects the most advantageous volume efficiency, as described above, for holding liquid ink. A type of felt suitable for this purpose is manufactured by BMP of America, Medina, N.Y.

It has been found, in order to provide the back pressure of liquid ink within the desired range, while still providing a useful volume efficiency and portability, that the polyester fibers forming the needled felt should be of two intermingled types, the first type of polyester fiber being of a greater fineness than the second type of polyester fiber. Specifically, an advantageous composition of needled felt comprises approximately equal proportions of 6 denier and 16 denier polyester fibers.

Medium 18 is packed inside the enclosure of housing 12 in such a manner that the felt exerts reasonable contact and compression against the inner walls. In one commercially-practical embodiment of the invention, the medium 18 is created by stacking three layers of needled felt, each one-half inch in thickness, and packing them inside the housing 12.

Also within housing 12 is a member made of a material providing a high capillary pressure, indicated as scavenger 20. Scavenger 20 is a relatively small member which serves as a porous capillary barrier between the medium 18 and the output port 16, which leads to the manifold of printhead 100. In the preferred embodiment of the invention, scavenger 20 is made of an acoustic melamine foam, which is felted (compressed with heat and pressure) by 50% in the direction of intended ink flow. One suitable type of melamine foam is made by Illbruck USA, Minneapolis, Minn., and sold under the trade name "WILTEC." The scavenger 20 preferably further includes a filter cloth, indicated as 22, which is attached to the melamine using a porous hot-melt laminating adhesive. In general, the preferred material for the filter cloth 22 is monofilament polyester screening fabric. This filtered cloth provides a number of practical advantages. Typically, no specific structure (such as a wire mesh) for holding the scavenger 20 against the opening into outlet port 16 is necessary. Further, there need not be any adhesive between the filter cloth 22 and the outlet port 16. The high capillary force provided by filter cloth 22 creates a film of ink between the filter cloth 22 and the outlet port 16, by virtue of the planarity (no wrinkles or bumps) of the filter cloth 22 against the scavenger 20, the compression of the scavenger 20 against the outlet port 16, and the saturation of the scavenger 20. This film serves to block out air from the outlet port 16.

In FIG. 1A, it can be seen that one portion of the outer surface of scavenger 20 abuts the medium 18, while other portions of the surface are exposed to open space, indicated as 15, between the medium 18 and the inner walls of housing 12. The single chamber 13 is so designed that a given quantity of ink may conceivably flow to or from the medium 18, to or from the scavenger 20, or to or from the free space within the chamber 13; that is, there are no solid internal barriers to the flow of ink within chamber 13. Generally, this arrangement serves to maintain the back pressure of liquid ink within a manageable range while the copy cartridge is slowly emptied of liquid ink. Because ink transmittance through medium 18 is not rapid enough to supply ink continuously to printhead 100, and because the felt of medium 18 does not provide the necessary seal to permit continuous, air-free flow of ink through outlet port 16, scavenger 20 is intended to act as an ink capacitor, from which ink can be drawn even under conditions of a high rate of ink demand, as will be explained in detail below.

In a typical commercial thermal ink jet printing apparatus, wherein the printhead is moved across a sheet in a number of swaths, the time for printing an eight-inch swath is approximately 0.5 seconds. The time in which the cartridge 10 changes direction between printing swaths is approximately 0.1 seconds. The scavenger 20 tends to desaturate during the printing of a swath, as ink is placed on the sheet; the time between printing swaths is useful as a "recovery" time in which the scavenger 20 is allowed to resaturate, thereby returning to an equilibrium back pressure.

In one commercially-practical embodiment of the present invention, the medium 18 is initially loaded with 68 cubic centimeters of liquid ink, of which it is desired to obtain at least 53 cubic centimeters for printing purposes while the back pressure of the cartridge is within a usable range. A typical volume of the scavenger 20 is two cubic centimeters. In printing a typical eight-inch swath in the course of printing a document, the scavenger 20 may be desaturated by up to 2.5% of the ink therein in 0.5 seconds, and this desaturation will cause an increase in back pressure at the printhead 100. This principle can best be envisioned by analogy to a common sponge: it is easier to squeeze out a quantity of liquid from a saturated sponge than it is to squeeze out the same quantity of liquid from a less-saturated sponge, even if the necessary amount of liquid is in the nearly-dry sponge. As desaturation causes an increase in back pressure with any absorbent medium, this back pressure will increase significantly in the course of printing a single swath of significant density across a sheet.

However, although desaturation of scavenger 20 will cause an increase in back pressure at the printhead 100, this increased back pressure from scavenger 20 works in the other direction as well. That is, desaturation of scavenger 20 will also cause a negative pressure against the medium 18, thereby causing a quantity of liquid ink to move from medium 18 to the scavenger 20, thereby resaturating scavenger 20 and thereby lowering the back pressure thereof. In this way the combination of medium 18 and scavenger 20 acts as a system for stabilizing the back pressure at printhead 100 as the supply of ink in medium 18 decreases.

Figure 2B:
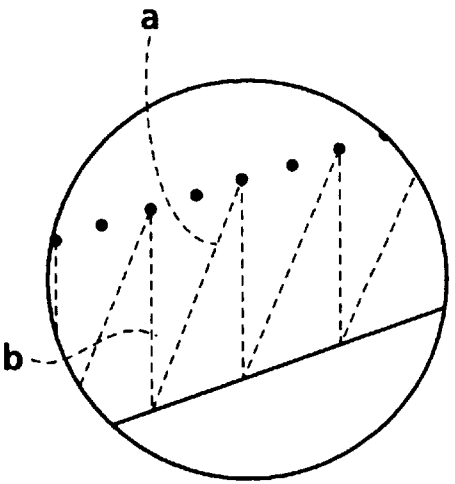
FIG. 2B is a detail of the graph of FIG. 2A.
Figure 2A:
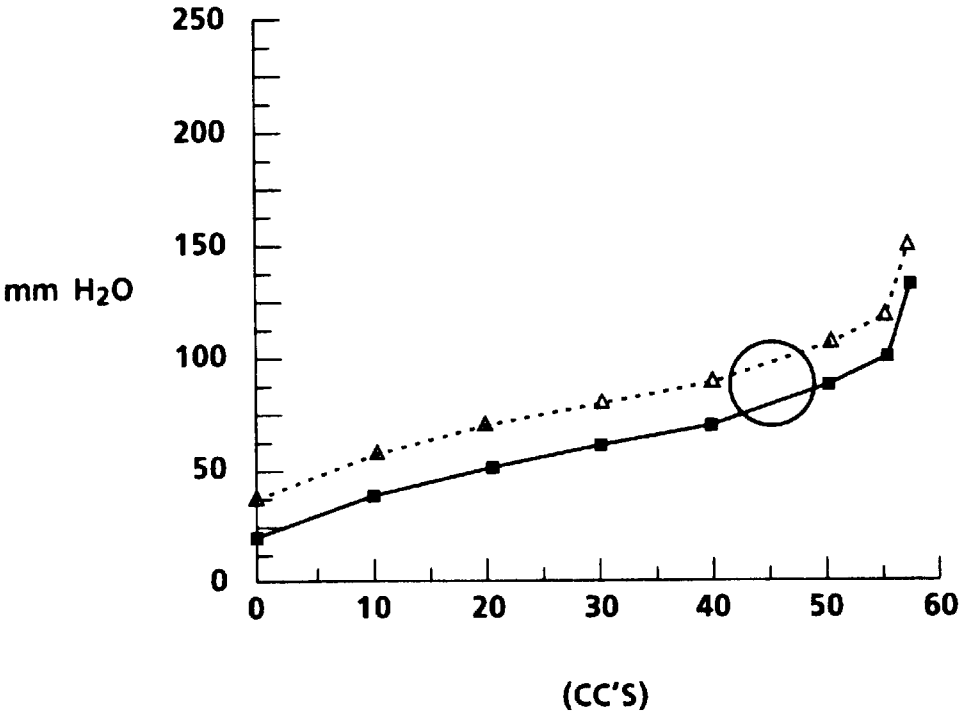
FIG. 2A is a graph illustrating back pressure of liquid ink as a function of the amount of ink in the cartridge.

FIGS. 2A and 2B are graphs showing the performance of a cartridge 10 made according to the preferred embodiment of the present invention, showing that the back pressure maintained at the printhead 100 is kept within a usable range for a great portion of ink levels in the copy cartridge 10. In FIG. 2A, the X-axis represents the volume of ink delivered through the printhead 100 (i.e., as the cartridge empties out), while the Y-axis represents the back pressure at the printhead in millimeters of water, which is, on the whole, comparable to millimeters of liquid ink. As can be seen clearly in FIG.

2A, with the preferred embodiment of the present invention, the back pressure is maintained at the best range, 12.5 mm to 125 mm, up to the point where over 55 cc's of ink are delivered. In the preferred embodiment, the cartridge 10 is originally loaded with 68 cc's of ink, and so therefore, only a reasonably small amount of ink is wasted because of insufficient back pressure. In the graph of FIG. 2A can be seen two lines; the solid line being the "static capillary pressure" of the cartridge at the printhead 100, while the dotted line above the solid line represents momentary back pressures created in the course of printing out individual swaths across a sheet, as in a typical context of printing documents such as the apparatus shown generally in FIG. 4.

FIG. 2B is a detailed view of a portion of the graph of FIG. 2A, showing a typical behavior of back pressure in a copy cartridge 10, in the course of continuous or substantially continuous use. In the type of thermal ink jet printing apparatus as shown in FIG. 1, the copy cartridge 10 reciprocates across the copy sheet so that printhead 100 may print out an image, in a series of parallel swaths, on the copy sheet. Each swath across the copy sheet typically lasts 0.5 seconds, while the turnaround time at the end of each swath is approximately 0.1 seconds (in typical commercial embodiments, the printhead 100 ejects ink onto the copy sheet when the copy cartridge 10 is moving in either direction). As mentioned above, liquid ink is drawn out of the copy cartridge 10 in the course of printing a swath, and the scavenger 20 substantially resaturates during the momentary changes of direction of the copy cartridge 10. When the scavenger 20 (and, by extension, the entire ink supply including medium 18) desaturates even only slightly, the back pressure will increase. In substantially continuous use of the copy cartridge 10, the periodic desaturating and resaturating of scavenger 20 translates into a cyclical pattern of increasing and re-correcting back pressures, which can be seen in FIG. 2B.

In FIG. 2B, the finely-dotted lines, forming a sawtooth pattern with increasing portions a and decreasing portions b, show the actual continuous-time behavior of the back pressures between the solid line (static capillary back pressure) and the local maxima indicated generally by the larger dotted line visible in FIG. 2A. With each sawtooth, the momentary increases shown by portion a represent the increase in back pressure as the ink supply system gives up ink in the course of printing a swath; the relatively quicker down portions b of each sawtooth represent the relatively rapid resaturation of the scavenger 20 in the turnaround times. In addition to the desaturation of the medium 18, another source of back pressure in a cartridge such as 10 is the "impedance" of ink flow through the various elements of the cartridge 10, caused by various shear forces among the medium 18, scavenger 20, and other parts. There are also shear forces at the microscopic level, for example, within the felt of medium 18 and the foam of scavenger 20.

In this way, it can be seen that the structure and materials of the present invention provide not only the desired range of back pressures toward the printhead in a consistent manner over the life of the copy cartridge, but also maintain a relatively consistent level of back pressure, even in the course of continuous use of the copy cartridge.

While this invention has been described in conjunction with a specific apparatus, it is evident that many alternatives, modifications, and variations will be apparent to those skilled in the art. Accordingly, it is intended to embrace all such alternatives, modifications, and variations as fall within the spirit and broad scope of the appended claims.

What is claimed is:

1. A system for supplying liquid ink to an ink-jet printing apparatus, comprising:

a housing defining a chamber having a ventilation port and an outlet port;

a medium occupying a portion of the chamber, the medium having a capillary force associated therewith for retaining a quantity of liquid ink;

a scavenger member of a predetermined volume disposed across the outlet port, providing a capillary force greater than the capillary force of the medium; and a free space defined within the housing adjacent a surface of the scavenger member, wherein ink is flowable between the scavenger member and the free space, the free space being of a volume not less than the volume of the scavenger member.

2. A system as in claim 1, wherein the medium is so disposed relative to the scavenger member within the chamber so that a portion of the medium directly contacts a surface of the scavenger member.

3. A system as in claim 2, further including means defining a channel defined through the medium for permitting substantially direct ventilation of open space within the chamber.

4. A system as in claim 1, further including a thermal ink jet printhead in communication with the outlet port.

5. A system as in claim 4, wherein the ink supply system and the thermal ink jet printhead are constructed as a unitary cartridge.

6. The system of claim 1, the free space being of a volume not less than twice the volume of the scavenger member.

7. The system of claim 1, wherein the free space is defined adjacent a surface of the medium.

* * * * *